US011524840B2

(12) United States Patent
Van Laarhoven et al.

(10) Patent No.: US 11,524,840 B2
(45) Date of Patent: Dec. 13, 2022

(54) LIQUID STABILIZING INLINER FOR A TANK CONTAINER

(71) Applicant: MEGA-INLINER INTERNATIONAL GROUP B.V., Valkenswaard (NL)

(72) Inventors: Sidonius Joseph Victor Marie Van Laarhoven, Valkenswaard (NL); Wilhelmus Theodorus Maria Van Barschot, Valkenswaard (NL)

(73) Assignee: MEGA-INLINER INTERNATIONAL GROUP B.V., Valkenswaard (NL)

( * ) Notice: Subject to any disclaimer, the term of this patent is extended or adjusted under 35 U.S.C. 154(b) by 0 days.

(21) Appl. No.: 17/288,270

(22) PCT Filed: Oct. 24, 2019

(86) PCT No.: PCT/NL2019/050700
§ 371 (c)(1),
(2) Date: Apr. 23, 2021

(87) PCT Pub. No.: WO2020/085906
PCT Pub. Date: Apr. 30, 2020

(65) Prior Publication Data

US 2021/0387798 A1 Dec. 16, 2021

(30) Foreign Application Priority Data

Oct. 25, 2018 (NL) ..... 2021873

(51) Int. Cl.
*B65D 90/04* (2006.01)
*B65D 90/52* (2006.01)

(52) U.S. Cl.
CPC ..... *B65D 90/046* (2013.01); *B65D 90/52* (2013.01); *B65D 2590/046* (2013.01)

(58) Field of Classification Search
CPC ..... B65D 90/046; B65D 90/52; B65D 2590/046; B65D 90/04; B65D 90/02;
(Continued)

(56) References Cited

U.S. PATENT DOCUMENTS 5,059,084 A * 10/1991 Krein ..... B65D 90/046 414/373
6,726,052 B1 * 4/2004 Miller ..... B65D 90/00 220/666

(Continued)

FOREIGN PATENT DOCUMENTS

CN 1352615 6/2002
JP H03256887 11/1991

(Continued)

OTHER PUBLICATIONS

International Search Report for PCT/NL2019/050700, dated Jan. 31, 2020, 4 pages.

(Continued)

*Primary Examiner* — Don M Anderson
(74) *Attorney, Agent, or Firm* — Nixon & Vanderhye P.C.

(57) ABSTRACT

The invention relates to a liquid-stabilizing inliner for use in a tank container, comprising an inliner having an inliner wall made of a film material, wherein the inliner wall 1) is configured as a bag to define an interior space for storing a liquid, 2) has an opening for the entrance of the liquid into the interior space, 3) has an inner surface facing the interior space and an outer surface facing an exterior environment; characterized in that an inflatable unit is connected to the inliner, the inflatable unit comprising a film material that is configured as a bag to define an interior space for containing a gas. The inflatable unit reduces sloshing of the liquid when a tank container with the inliner is partly filled with liquid.

(Continued)

The inflatable unit may also function as a handle for removing the liquid-stabilizing after use.

15 Claims, 3 Drawing Sheets

(58) Field of Classification Search
CPC .... B65D 90/047; B65D 90/048; B65D 90/56; B65D 90/58
See application file for complete search history.

(56) References Cited

U.S. PATENT DOCUMENTS

| | | | | |
|---|---|---|---|---|
| 10,717,596 | B1 * | 7/2020 | Archer, Jr. | B65D 90/046 |
| 10,836,298 | B1 * | 11/2020 | Bonnar | B65D 90/046 |
| 2007/0095423 | A1 * | 5/2007 | Vigano | B65D 81/052 141/114 |
| 2010/0032053 | A1 * | 2/2010 | Chong | B65D 90/046 141/10 |
| 2013/0101237 | A1 * | 4/2013 | Kohen | B65D 88/22 383/38 |
| 2014/0097182 | A1 * | 4/2014 | Sheesley | B65D 90/587 29/401.1 |
| 2016/0130078 | A1 * | 5/2016 | Galvin | B65D 90/0066 141/1 |
| 2016/0355332 | A1 * | 12/2016 | Scudder | B65D 90/52 |
| 2017/0225885 | A1 * | 8/2017 | Sullinger | B65D 88/54 |
| 2017/0253425 | A1 * | 9/2017 | McKee | B65D 77/06 |
| 2017/0253427 | A1 * | 9/2017 | Hindbo | B65D 88/08 |
| 2018/0339848 | A1 * | 11/2018 | McKee | B62B 1/14 |
| 2019/0375582 | A1 * | 12/2019 | Kotora | B65D 88/128 |
| 2020/0115151 | A1 * | 4/2020 | Kohen | B65D 88/1656 |
| 2020/0140190 | A1 * | 5/2020 | Van Laarhoven | B65D 88/28 |
| 2021/0032017 | A1 * | 2/2021 | Tang | B65D 90/024 |
| 2021/0323759 | A1 * | 10/2021 | Parenzee | B01F 33/409 |
| 2021/0387798 | A1 * | 12/2021 | Van Laarhoven | B65D 90/52 |
| 2022/0002075 | A1 * | 1/2022 | Aljrbi | B65D 88/16 |
| 2022/0003360 | A1 * | 1/2022 | Aljrbi | B65D 90/50 |
| 2022/0055830 | A1 * | 2/2022 | Kotora | B65D 90/046 |
| 2022/0063904 | A1 * | 3/2022 | Lang | B65D 88/22 |

FOREIGN PATENT DOCUMENTS

| | | |
|---|---|---|
| WO | WO 00/66461 | 11/2000 |
| WO | 2007/081201 | 7/2007 |
| WO | 2011/159265 | 12/2011 |
| WO | 2014/124619 | 8/2014 |

OTHER PUBLICATIONS

Written Opinion of the ISA for PCT/NL2019/050700, dated Jan. 31, 2020, 6 pages.
CN Application No. 201980079995.6, First Office Action dated Mar. 8, 2022.

* cited by examiner

LIQUID STABILIZING INLINER FOR A TANK CONTAINER

This application is the U.S. national phase of International Application No. PCT/NL2019/050700 filed 24 Oct. 2019, which designated the U.S. and claims priority to NL Patent Application No. 2021873 filed 25 Oct. 2018, the entire contents of each of which are hereby incorporated by reference.

The invention relates to a liquid-stabilizing inliner for use in a tank container, to a method for preparing such inliner, to an assembly of such liquid-stabilizing inliner and a tank container, and to a method for preparing such assembly.

For the transportation and storage of liquid products, it is common practice to use containers wherein such liquids temporarily reside, and which have dimensions that allow them to be transported by trucks, trains and (container) ships. Such containers are usually filled and emptied via a drain hole that is present at or near their bottom. Other holes may also provide access to the inside of the container, such as a manhole or a venting hole. A particular type of container for transporting liquids is a so-called tank container. These containers are among the largest containers for this purpose. Their volume usually ranges from 10,000 $m^3$ to 50,000 $m^3$. They have a typical content of about 25,000 $m^3$, and are shaped in a more or less cylindrical form.

To avoid contact of the charged liquid with the inside of the tank container, an inliner may be used inside the container, so that the container does not have to be cleaned after use. Instead, the inliner is then simply removed from the container, after which the container is ready for re-use. A further advantage of such inliner is that it protects the liquid in the container against contamination, decay and spoilage.

When a tank is partially filled with a liquid, it is commonly known that movement of the tank (acceleration) causes the liquid inside to slosh. This may increase fatigue that is harmful to the tank container. Another effect of a sloshing liquid is an increased instability of the tank container during transport. For example, vehicles carrying such tank container risk loss of balance and control; and tankers at sea risk turnover during maneuvering (in particular turning) when fluid accumulates at one side of the tank container.

Moreover, when an inliner is used to in the container, then the inliner is also at risk. The sloshing results in high and repetitive mechanical forces that may disrupt the inliner.

It is known to solve the problem of sloshing in tank containers by placing dampers in the tank container, such as baffles or other rigid structures that slow down liquid flow in the tank container (as is e.g. the case in WO2014124619A1). Such solutions can however not be applied in combination with an inliner, because it is highly impractical to place baffles or other rigid structures in the interior space of the inliner. When placed at the exterior environment around the inliner (but inside the tank container), they obstruct the inliner so that it cannot reach the required unfolding and the desired volume. Such dampers may even damage the inliner.

It is therefore an object of the present invention to provide means that stabilize the liquid in a partly filled tank container when the liquid is held in an inliner, so that the sloshing of the liquid is reduced.

It has now been that the use of a particular item in combination with the inliner can solve this problem. Accordingly, the present invention relates to a liquid-stabilizing inliner for use in a tank container, comprising an inliner having an inliner wall made of a film material, wherein the inliner wall is configured as a bag to define an interior space for storing a liquid;

has an opening for the entrance of the liquid into the interior space;

has an inner surface facing the interior space and an outer surface facing an exterior environment;

characterized in that an inflatable unit is connected to the inliner, wherein the inflatable unit is present in the interior space or in the exterior environment.

Figure 7:
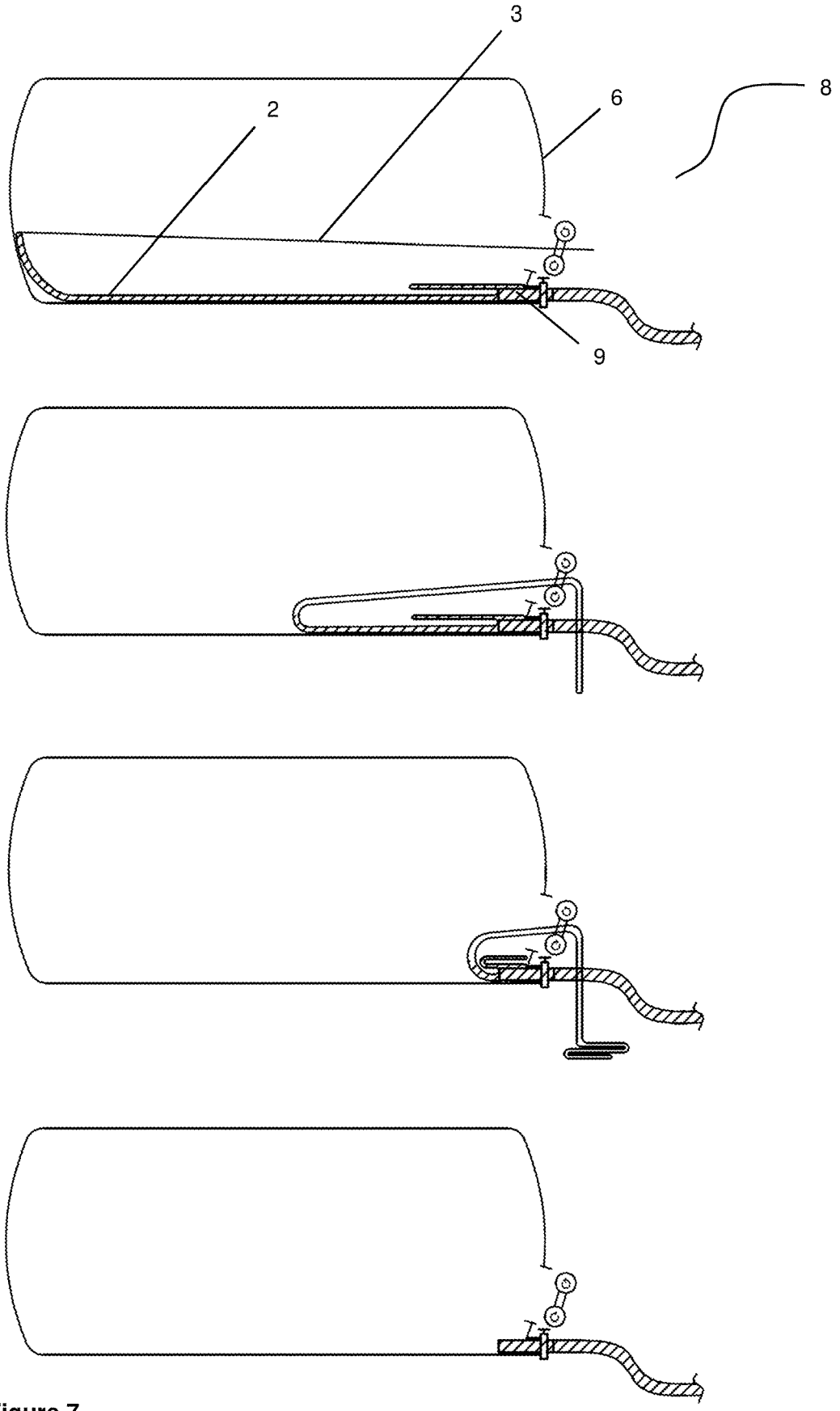

FIG. 7 displays in a series of four cross-sectional views how the inliner may be pulled out of the tank container with the aid of the inflatable unit.

Elements in the figures are illustrated for simplicity and clarity and have not necessarily been drawn to scale. For example, the dimensions of some of the elements in the figures may be exaggerated relative to other elements to help improve understanding of various exemplary embodiments of the present invention. Furthermore, the terms "first", "second", and the like herein, if any, are generally used for distinguishing between similar elements and not necessarily for describing a sequential or chronological order.

A liquid-stabilizing inliner of the invention is formed by an inliner and an inflatable unit that is connected to the inliner. The inliner may in principle be any inliner that is suitable for use in a tank container. Such inliner is in fact a bag that is formed by an inliner wall. The inside of the bag is the interior space wherein a liquid can be stored and/or contained. Outside the bag is the exterior environment. The inliner wall has an inner surface that faces the interior space and an outer surface that faces the exterior environment.

The inliner wall is made of a film material. Such material is flexible so that the inliner can be in a folded state when empty, and is capable of unfolding during filling of the inliner with a liquid so that it can adopt the shape of the tank container. The actual volume of the interior space depends on the shape of the inliner wall. During filling of the inliner, the inliner wall will change its shape so as to enclose an increased volume, thereby increasing the volume of the interior space. Suitable film materials for the inliner wall are known in the art. For example, such material is layered and so comprises a plurality of layers that have been glued together. Usually, the material comprises at least one barrier layer that is impenetrable to air and/or water.

The inliner wall thus separates the interior space from the exterior environment. To this end, the inliner in principle completely encloses the interior space. The inliner wall (and thus also the inliner itself) however comprises an opening to allow the passage of liquid, so that the inliner can be filled with a liquid. Such opening also allows the discharge of liquid from the inliner. Preferably, an opening in the inliner wall is capable of being closed, e.g. with a cap or stopper, so that the interior space can be completely shut off from the exterior environment. To this end, the opening comprises a spout (e.g. it merges into a spout) that can act as a receiver for such cap or stopper. The inliner preferably comprises one opening, but it is in principle also possible that a plurality of openings is present.

Tank containers in which inliners of the invention are applied are usually of an elongated shape. As a result, inliners for such containers are then also of an elongated shape. Accordingly, a liquid-stabilizing inliner of the invention usually has an elongated shape.

The shape of an inliner is typically a rectangular shape when the inliner is empty and flat. This means that it has a longitudinal dimension (a long dimension—its length) and a transverse dimension (a short dimension—its width), which dimensions are perpendicular. The inliner therefore has two long edges and two short edges. The edges may be straight or slightly curved, and the corners of the rectangular shape may be sharp or curved.

Elongated tank containers comprise a first end, a second end, and a longitudinal axis extending from the first end to the second end. In particular, a tank container is of a cylindrical or cylindrical-like shape. Such tank containers comprise a circumferential wall that is present between a wall at the first end and a wall at the second end.

The inflatable unit of a liquid-stabilizing inliner of the invention has a wall made of a film material, wherein the wall is configured as a bag to define an interior space that is capable of being filled with a gas (i.e. inflated), so that the volume of the inflatable unit can be increased. The film material is preferably a tubular film of which the ends of have been closed, e.g. by squeezing them together. When inflated, such inflatable unit (or a part thereof when the unit comprises a plurality of inflated sections) typically has the appearance of a cushion or a pillow. The inflatable unit is not necessarily inflatable as a separate unit, i.e. the situation wherein an inflatable unit is disconnected from the inliner. For example, the inflatable unit may also share one of its walls with a wall of the inliner. In such case, the inflatable unit may be formed by connecting (e.g. sealing) a sheet of the film material to a part of the inliner wall. When a gas-tight connection is formed along all edges of the sheet, an interior space is formed for containing a gas (i.e. a gas with which the inflatable unit is inflated).

Prior to using a liquid-stabilizing inliner of the invention in a tank container, the inflatable unit is preferably not inflated, i.e. it contains essentially no gas. This saves space, allows the inliner to be folded and/or rolled up, and allows an easy entrance of the inliner into the tank container. When unfolded and not rolled up, a liquid-stabilizing inliner of the invention is essentially flat. Inflation of the inflatable unit is usually only performed during use in the tank container when there is a space between the container wall and the inliner, and when this space gives rise to sloshing of the liquid to an undesired extent.

Figure 1:
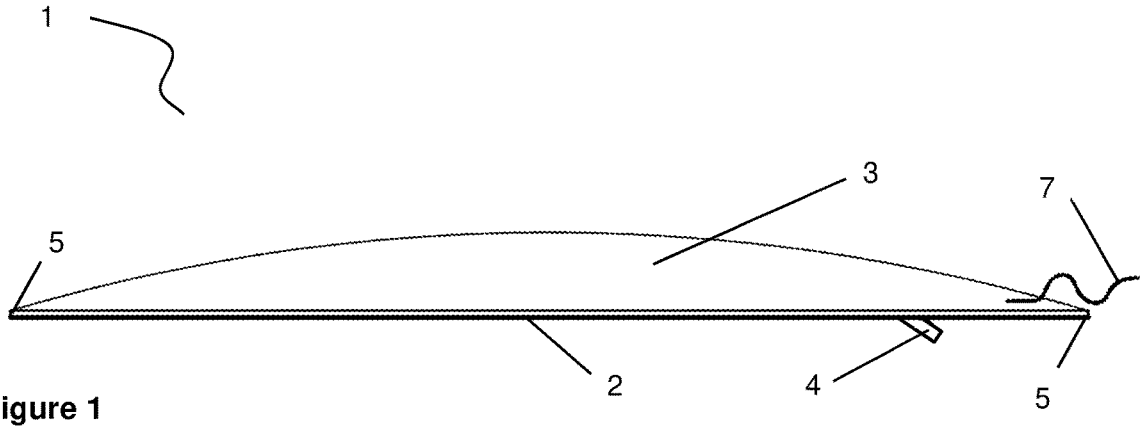
FIG. 1 is a side view of a first embodiment of a liquid-stabilizing inliner according to the invention, having a non-compartmentalized inflatable unit.
Figure 2:
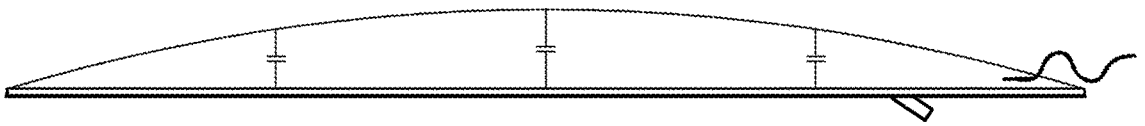
FIG. 2 is a side-view of a second embodiment of a liquid-stabilizing inliner according to the invention, having a compartmentalized inflatable unit.

FIGS. 1 and 2 display a side-view of the situation wherein a liquid-stabilizing inliner of the invention resides outside a tank container in an unfolded and non-rolled-up state, while the inliner is empty (and flat) and the inflatable unit is inflated (and not flat). In FIG. 1 the inflatable unit consists of one compartment; in FIG. 2 it consists of four compartments that are in fluid connection with each other by a small opening between the compartments. The representations in FIGS. 1 and 2 do course not display a situation of normal use of the liquid-stabilizing inliner (because then the liquid-stabilizing inliner itself would be inside a tank container and the inliner would contain a liquid), but they clearly demonstrate how the inflatable unit is positioned relative to the inliner.

Figure 3:
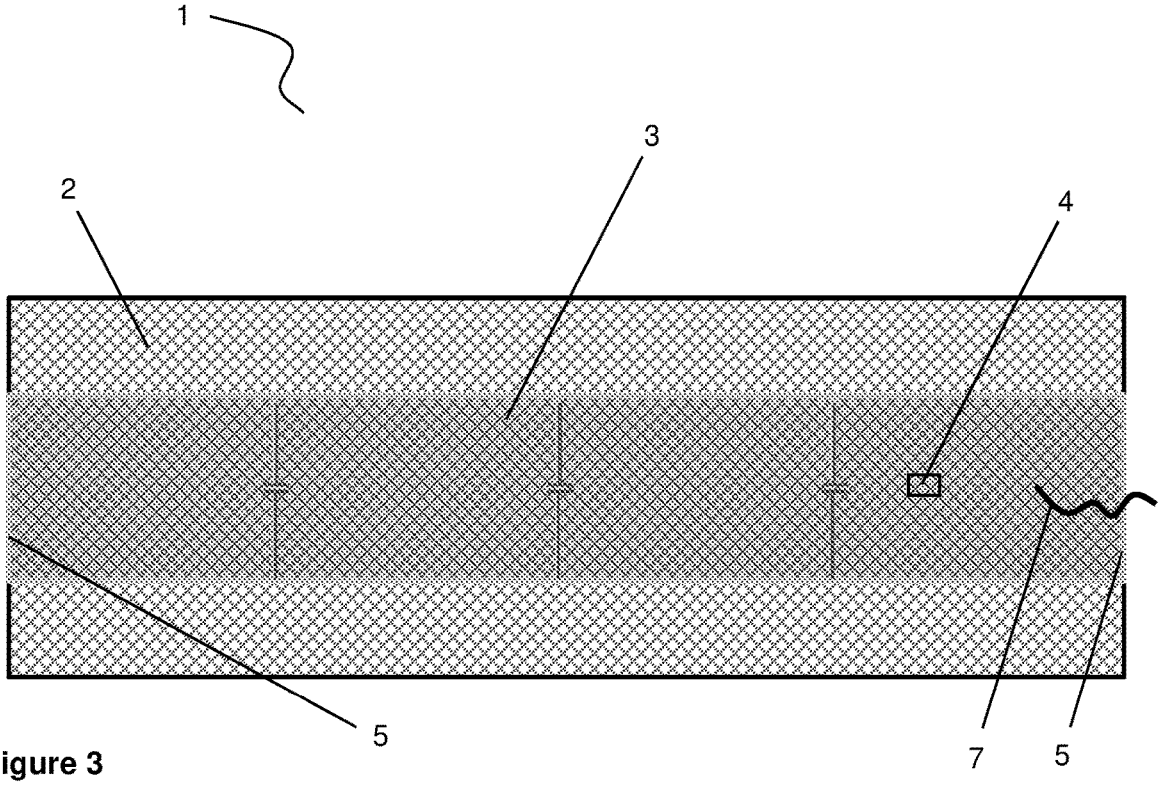
FIG. 3 is a top-view of a liquid-stabilizing inliner of the invention, having a compartmentalized inflatable unit.

FIG. 3 is a top-view of a flat liquid-stabilizing inliner wherein the inflatable unit is not inflated and the inliner is empty. The inflatable unit (grey-shaded) is present on top of the inliner (patterned with squares). The inliner and the inflatable unit have an equal length, but a different width. The inflatable unit comprises four compartments that are in fluid connection with each other by a small opening between the compartments.

The inflatable unit usually comprises means for inflating the unit, such as an element selected from the group of a valve, a tube and a container with compressed gas. When a valve and/or a tube are present, they are connected to the unit. A tube (7) may pass the wall of the tank container at a suitable location or is connected to a venting hole of the tank container. This allows inflation of the inflatable unit from the outside of the tank container. This is shown in FIGS. 4 and 5.

Figure 4:
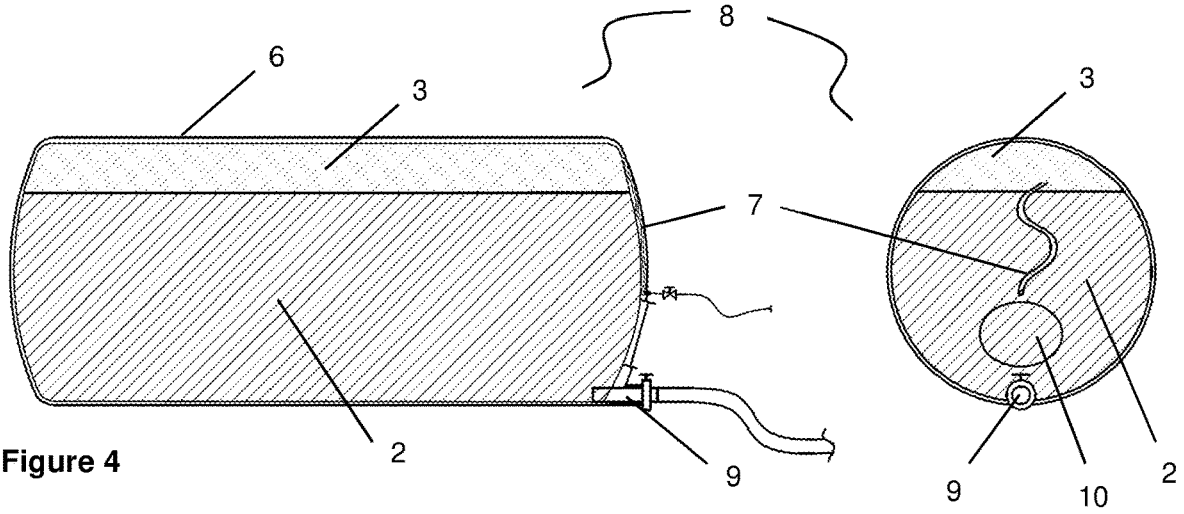
FIG. 4 is a cross-section of a first embodiment of an assembly of a liquid-stabilizing inliner and a tank container according to the invention.
Figure 5:
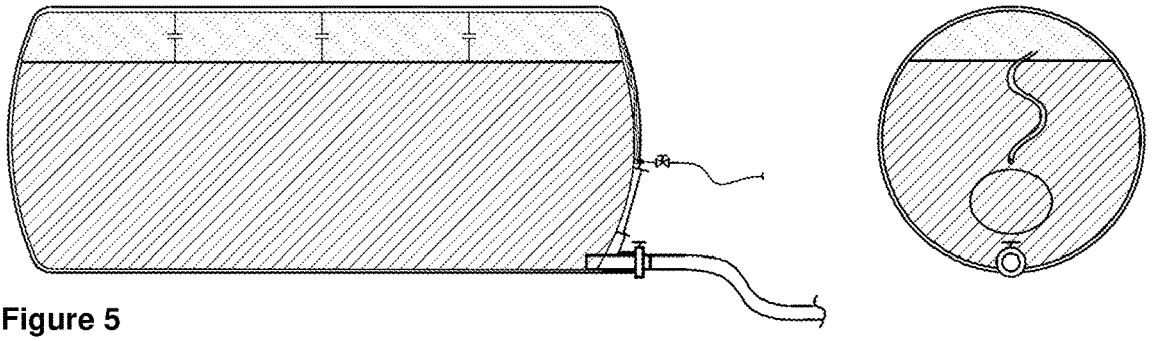
FIG. 5 is a cross-section of a second embodiment of an assembly of a liquid-stabilizing inliner and a tank container according to the invention.

FIG. 4 displays an assembly of a liquid-stabilizing inliner according to the invention and a tank container, wherein the inflatable unit consists of one compartment. FIG. 5 displays this liquid-stabilizing inliner with four compartments in the inflatable unit.

The inflatable unit is connected to the inliner. It is in particular connected to a surface of the inliner wall. It may be connected to the inner surface of the inliner wall or to the outer surface of the inliner wall. When present in the interior space, it is connected to the inner surface; when present in the exterior environment, it is connected to the outer surface. When present in the interior space, the inflatable unit may be considered as being a compartment of the interior space.

When present in the exterior environment, the inflatable unit is typically connected to the outer surface of the inliner wall. Preferably, the inflatable unit is then connected to the inliner by means of at least two connections. It is however also possible that it is connected with only one connection.

The connection between the inliner and the inflatable unit may be obtained by sealing both items together. In such case, the film material of the inliner wall as well as the film material of the inflatable unit is made of a sealable material, such as a material that comprises a polyolefin, in particular polyethylene. Preferably, both film materials are the same (since this usually provides the best sealing result). Differences in the materials are however allowed, for example the presence of a barrier layer. The material of the inflatable unit does not require a barrier layer, while this is preferred for the material of the inliner itself. Sealing of materials that differ only in the presence of such barrier layer has been shown to still provide a connection with sufficient strength and durability.

The connection by means of sealing may be performed by squeezing a part of the inflatable unit (preferably an edge) on top of a part of the inliner (preferably also an edge) in a press under the addition of heat (heat sealing). The resulting sealing line then connects both parts. Such sealing line may have a width in the range of 2-20 cm. Thus, the connections of the inflatable unit with the inliner may comprise a sealing, in particular a heat sealing.

In another method of connecting the inliner and the inflatable unit, the connection is made by means of sealing tape. This may be tape that sticks on both sides. Its application may require heating the tape and the two surfaces that are to be connected, but its application may also be performed at ambient temperature.

In a preferred embodiment of a liquid-stabilizing inliner according to the invention, the inflatable unit as well as the inliner are of an elongated shape. Such shapes have a longitudinal dimension in the direction wherein the shape is elongated. Preferably, the longitudinal dimensions of the inliner and the inflatable unit are aligned when the inliner is connected to the inflatable unit (such coinciding longitudinal dimensions then form the longitudinal dimension of the liquid-stabilizing inliner according to the invention).

In a liquid-stabilizing inliner of the invention, the inflatable unit may be connected to the inliner over the entire length of the inflatable unit. Preferably, however, there are two connections that are separated from each other. In such liquid-stabilizing inliner, a first connection between the inflatable unit and the inliner is located at or near a first end of the inliner; and a second connection is located at or near a second end of the inliner. Such mode of connection keeps both items aligned and causes an effective damping of the sloshing when applied in a tank container. Optionally, more connections are present between the first connection and the second connection.

Accordingly, a liquid-stabilizing inliner according to the invention may be one wherein

- the inflatable unit as well as the inliner are of an elongated shape, in particular of a rectangular shape, each having a first end and a second end, a longitudinal dimension between both ends, and a length that is defined as the distance between the first end and a second end, measured over the surface of the inflatable unit or the inliner, respectively;
- the relative orientation of the inliner and the inflatable unit is such that their longitudinal dimensions are aligned;
- the inflatable unit is present in the exterior environment;
- the inflatable unit is connected to the inliner by means of at least two connections, wherein a first connection is located at the first end of the inliner and/or at distance therefrom of 25% of the inliner's length, and a second connection is located at the second end of the inliner and/or at distance therefrom of 25% of the inliner's length.

Apart from the reduction of sloshing (and thus stabilizing the liquid), the inflatable unit may also have a second function when the liquid-stabilizing inliner is used in a tank container. It may function as a handle, which has a twofold advantage; 1) for removing the liquid-stabilizing inliner after use; and 2) for optimal discharge of last traces of liquid from the inliner.

An operator usually has to perform all handling with respect to installing and removing the inliner whilst standing outside the tank container (for reasons of safety, for example). Removing the inliner from the tank container is then difficult because 1) it is heavy due to traces of liquid in the inliner and 2) only sections close to the manhole can be reached.

Moreover, any amount of liquid that remains in the inliner after its removal is essentially a lost amount, because recovery of the liquid from the inliner at that stage is highly undesired, for example because the sterility has been lost and product quality cannot be guaranteed anymore.

With a liquid-stabilizing inliner of the invention, these two difficulties can be overcome when the inflatable unit is also used as a handle for the liquid-stabilizing inliner.

The first difficulty is overcome in the following way. When the inflatable unit is partly or completely deflated after use, the operator can reach it and pick it up from outside the tank container, through the manhole. By pulling it, he can remove the entire liquid-stabilizing inliner from the tank container.

The second difficulty is overcome in the following way. When the operator starts pulling at a section of the inflatable unit that is connected to the most remote end of the liquid-stabilizing inliner, then this side is the first part to be lifted up a little bit so that any traces of liquid in this end of the inliner flow towards the discharge opening of the container. When continuing the pulling, the remote end is moving towards to operator and any further traces of liquid are also guided to the discharge opening. In this way, also the last traces of the liquid can be discharged from the tank container. This, in turn, leads to an inliner of less weight, which facilitates the removal of the inliner from the tank container (and so also even more helps to overcome the first difficulty).

FIG. 7 displays in a series of four cross-sectional views how the liquid-stabilizing inliner may be removed from the tank container via the manhole whilst last traces of liquid are discharged from the inliner. This occurs by pulling at the (deflated) inflatable unit with a pulling unit, although an operator may also perform this pulling. The opening in the inliner wall merges into a spout that is removably connected to the drain hole of the tank container.

The upper view of FIG. 7 shows that the inflatable unit is connected to that end of the inliner that is most remote from the manhole and the drain hole of the tank container. By pulling at the inflatable unit, the remote end is moved towards the manhole. A pulling mechanism is placed close to the manhole to support the pulling, although this may in principle also be performed manually.

In the following views of FIG. 7, the progression of pulling the inliner is displayed. In the second view, the removal of the inliner is approximately halfway. In the third view, the inliner has almost completely been removed from the tank container. The removal has now arrived at the stage where the inliner needs to be disconnected from the tank container, which is typically the removal of the spout of the inliner from the drain hole of the tank container. The fourth view displays the tank container after the liquid-stabilizing inliner has been completely removed from the tank container.

Thus, the inflatable unit solves three problems at the same time; 1) it reduces the sloshing (i.e. stabilizes the liquid); 2) it facilitates the removal of the inliner from the tank container; and 3) it increases amount of liquid that is recovered from the tank container. Instead of making separate functionalizations on the inliner to solve these three problems (regardless of how these functionalizations might look like), there is now only one elegant modification of the inliner that solves all three problems at once. This makes the inliner less complicated, less vulnerable to malfunctioning, and easier to handle.

This method of simultaneous pulling and emptying works particularly well when the inflatable unit is connected at or near the most remote end, and not along the entire longitudinal dimension. Therefore, it is preferred that the connection at or near the remote end is located exactly at the remote end or at a small distance therefrom. Such distance is then not more than 25% of the length of the inliner. Analogously, the connection at or near the other end (i.e. the one close to the operator) is located exactly at that remote end or at a small distance therefrom. Such distance is then also not more than 25% of the length of the inliner. Thus, a liquid-stabilizing inliner according to the invention is preferably one wherein there is no connection between the inliner and the inflatable unit over a distance in the longitudinal dimension of at least 50% of the inliner's length, measured over the surface of the inliner, preferably at least 75%.

More preferably, the connections are located at each respective end of the inliner, so that the pulling and emptying goes even more smoother and effective. Thus, the first end of the inliner is then connected to the first end of the inflatable unit and the second end of the inliner is connected to the second end of the inflatable unit. In this configuration, the inliner and the inflatable unit in principle have equal lengths (when measured over their surfaces), or at least lengths with a minimal difference, for example with a difference of less than 1%. The short edges of the inliner then coincide with at least a part of the short edges of the inflatable unit, as is also the case with e.g. the liquid-stabilizing inliner of FIG. 3 (the long edges are of the same length, but the short edges are not). This has an advantage in the manufacturing of the liquid-stabilizing inliner, because the connections of the inflatable unit with the inliner can be combined with the manufacture of the inliner itself. When the inliner is prepared by sealing the edges of different layers of film material, the inflatable unit can be included in the sealing process, so that in one sealing step one sealing is prepared wherein the different layers as well as the inflatable unit participate.

FIG. 6 visualizes how the lengths over which the inliner is connected to the inflatable unit may differ. The bottom bold line in each view represents the inliner and the somewhat slimmer line above it represents the inflatable unit. The patterned areas between the ends of the lines represent the connection area between both lines, for example a connection via a sealing.

Figure 6A:
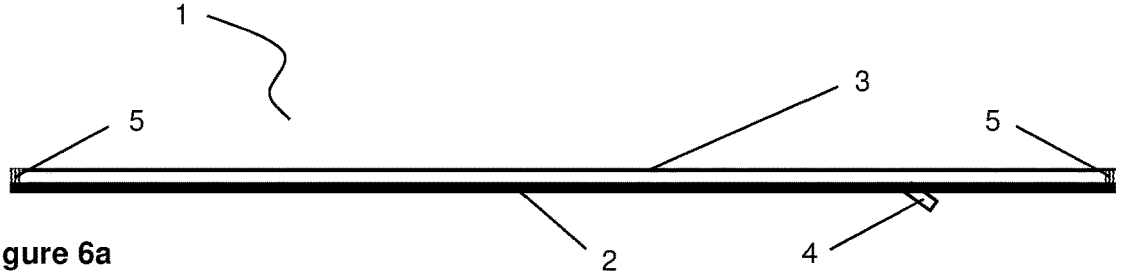
FIG. 6 is a visualization of how the length over which the inliner is connected to the inflatable unit may vary.
Figure 6B:
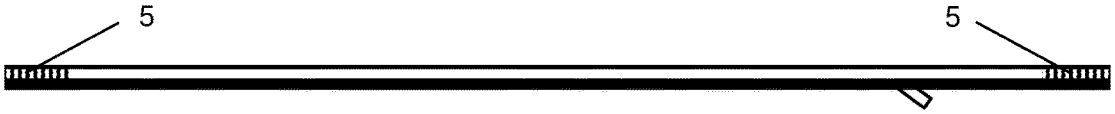
Figure 6C:
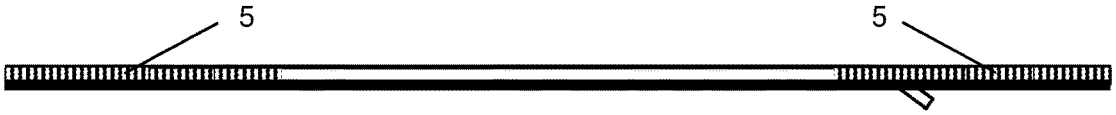

In FIG. 6*a*, the connection area is limited. It is typically a small sealing line of e.g. a 2-10 centimeters wide. This is the mostly preferred connection, because it achieves the best removal of liquid from those parts of the inliner that are most remote from the opening (good lifting of the remote end when the (empty) inflatable unit pulls the end up). Secondly, this mode of connection has advantages in the manufacturing. In FIG. 6*b*, the connection area is a bit larger. In FIG. 6*c*, the area is at its maximum allowable of 25% of the length of the inliner. The collection of liquid will be poorer and/or less convenient with the area of FIG. 6*b* and even poorer and/or even less convenient with the area of FIG. 6*c*.

As indicated above, it is in principle also possible that there is only one connection of the inliner with the inflatable unit. Such single connection is then located at one end of the inliner and/or at distance therefrom of 25% of the inliner's length. The particular end where the connection is located is the end that is most remote from the opening for the entrance of the liquid in the inliner. This is because, when the inliner is placed in a tank container, that connection is most remote from the manhole. Moreover, the free end of the inflatable unit is then closest to the manhole. An operator who has to remove the liquid-stabilizing inliner from the tank container so has an easy access to the free end, and can pull the inflatable unit through the manhole out of the tank container thereby collecting any last traces of liquid in the inliner and letting them flow towards the discharge opening of the container (the method of simultaneous pulling and emptying as also elaborated hereinabove). Though, it is preferred to have both ends of the inflatable unit connected to the inliner, since this limits the movement of the inflatable unit when it is inside the tank container and when it is active in reducing the sloshing of liquid in a partly filled inliner.

The inflatable unit may in principle be connected to any type of inliner that is suitable for use in a tank container. The inliner may for example be of a type wherein the inliner wall is made from a single piece of film material. This may concern a type wherein the entire wall lacks joints that connect different parts of the wall to each other. The only joint that can eventually be present in such wall is a joint around the opening in the wall, typically a joint that connects the wall with a spout.

It is however also a possibility that the inliner wall comprises a single piece of film material in the form of a tubular wall. Such tubular wall comprises a circumferential wall between two open ends, each of which comprises a circumferential edge. When each of these two open ends is closed, then an interior space is formed that is completely closed-off from the exterior environment. Such closure is typically performed by connecting opposite positions of the circumferential edge, in a way that is similar to how e.g. a plastic tube for e.g. toothpaste is closed at the end opposite to the end with the cap. When the film material of the inliner wall is made of a sealable material, such as material that comprises a polyolefin, in particular polyethylene, then the closure may achieved by squeezing each edge in a press under the addition of heat. The resulting sealing line then connects opposing portions of the tubular film, thereby closing the open end of the tubular film. Inliners of this type typically have a rectangular shape, having two edges substantially parallel to the sealing lines and two edges substantially perpendicular to the sealing lines.

Accordingly, in an embodiment of a liquid-stabilizing inliner according to the invention, the inliner wall comprises a tubular film having a first end and a second end, each of which is closed by means of a sealing line that connects at each end opposing portions of the tubular film, to thereby define the interior space for storing a liquid, wherein

- the inliner comprises two long edges and two short edges, wherein the first end of the tubular film coincides with one short edge and the second end of the tubular film coincides with the other short edge;
- a longitudinal dimension is present between the two short edges of the inliner;
- a transverse dimension is present between the two long edges of the inliner, the transverse dimension being perpendicular to the longitudinal dimension;
- the opening merges into a spout and is positioned on or adjacent to a central line extending along the longitudinal dimension of the inliner. comprising The central line is a line that is centered between both long edges of the inliner.

Yet another way of arranging a single piece of film material to form the inliner wall comprises

- folding a rectangular piece of tubular film once over a folding line halfway between both open ends so that both open ends coincide, yielding a rectangular shape having four edges, one which is formed by the folding line; then
- making a connection along three other edges to obtain an inliner having an inliner wall comprising a double layer of film (the inliner having four layers of film in total).

In this way, the interior space is not present inside the original tubular film, but between two portions thereof.

The inliner may also be of a type wherein the inliner wall is made from a plurality of pieces of material (as compared to the single piece of tubular film mentioned hereinabove). For example, such inliner is made from at least two stacked sheets, typically rectangular sheets, that are connected at their edges and so form a closed compartment (i.e. the interior space for storing a liquid).

When the inliner wall is double-layered, there is less chance on leaking in case there is a puncture in one of the sheets. For example, when four of such stacked sheets are connected at their edges, the interior space for storing a liquid is formed between the second and the third stacked layer. All the inliner walls of the resulting inliner are then double-layered walls. Therefore, preferably, the inliner is made of four (or more) sheets that are sealed together.

Accordingly, in an embodiment of a liquid-stabilizing inliner according to the invention, the inliner wall comprises at least two, preferably four, sheets of a rectangular shape lying on top of each other and being sealed together at their edges so as to configure the bag that defines the interior space for storing a liquid, wherein

- the inliner comprises two long edges and two short edges;
- a longitudinal dimension is present between the two short edges of the inliner;
- a transverse dimension is present between the two long edges of the inliner, the transverse dimension being perpendicular to the longitudinal dimension;
- the opening merges into a spout and is positioned on or adjacent to a central line extending along the longitudinal dimension of the inliner.

The central line is a line that is centered between both long edges of the inliner.

An alternative way to arrive at an inliner that comprises four layers of film material (so that it contains double-layered inliner walls), is by connecting two stacked pieces of tubular film at their edges. The interior space so created is not inside the original tubular film, but between two stacked pieces of tubular film, similar to how the space with four separate sheets is formed (as described hereinabove).

Thus, in several embodiments of the liquid-stabilizing inliner, the inliner itself comprises a variation in the position and number of the sealed edges. An inliner may comprise one, two, three or four sealed edges. When such inliners are used in a liquid-stabilizing inliner of the invention, it is preferred that the inflatable unit is also part of these sealed edges. This means that in the actual sealing, the different inliner layers as well as the material of the inflatable unit are combined in one seal. For example, the first end of the inflatable unit is connected to an edge of the inliner at the first end of the inliner, and the second end of the inflatable unit is connected to an edge of the inliner at the second end of the inliner. In particular, when the inflatable unit is of a rectangular shape having two long edges and two short edges, one short edge of the inflatable unit is connected to one short edge of the inliner and the other short edge of the inflatable unit is connected to the other short edge of the inliner, preferably by sealing the respective edges together.

Such combination of the inflatable unit with the sealed edges (rather than a connection somewhere in the middle of the surface) has the advantage that the inflatable unit does not cause tensions at the inliner's surface. This reduces the risk that the inliner is torn open after repeated loading of the connection.

Another advantage is that there is a large distance between the two connections, i.e. there is no connection between the inliner and the inflatable unit over a long distance in the longitudinal dimension. This distance may even be as long as the length of the inliner (measured over the surface of the inliner) minus twice the width of the sealing that connects the inliner and the inflatable unit. A longer distance facilitates the pulling of the liquid-stabilizing inliner out of the tank container, and at the same time the collection of liquid at the discharge opening of the tank is container is more effective. The distance over which there is no connection between the inliner and the inflatable unit in the longitudinal dimension may also be at least 50% of the inliner's length, measured over the surface of the inliner, preferably at least 75%, more preferably at least 85% and even more preferably at least 95%.

When the inliner is made by sealing a stack of elongated film material (tubular or layered) at its edges (as elaborated hereinabove), then it is of a cylindrical shape having squeezed ends when it would be inflated in the absence of a tank container. When the inflatable unit is made in a similar way, yielding also such cylindrical shape when inflated, then a liquid-stabilizing inliner according to the invention can be regarded as a composition of two cylinders of the same length but with different diameter, wherein both cylinders are aligned and their edges are squeezed and combined in one single seal.

The ratio of the diameter of both cylinders (the inliner and the inflatable unit) is then preferably in the range of 1.0:0.25 to 1.0:1.0. For example, when placed into a commonly used tank container with a cylindrical shape of an inner diameter of approximately 2.35 m, the inliner preferably has a cylinder diameter in the range of 2.40-3.20 m, and the inflatable unit preferably has a cylinder diameter in the range of 0.60-3.20 m, more preferably in the range of 0.80-2.80 m. It may also be in the range of 1.0-2.40 m.

FIG. 3 displays a top-view of a flat liquid-stabilizing inliner where the diameter of the inflatable unit is approximately half the diameter of the inliner. The outer rectangle represents the inliner, while the grey-shaded and smaller rectangle represents the inflatable unit.

As stated above, it is also possible that the inflatable unit shares one of its walls with a wall of the inliner. This is typically the case when a sheet is connected along all its edges to a part of the inliner wall. When the inliner is of the type that is made by sealing rectangular sheets and/or tubular films along all of their edges (as elaborated hereinabove), then the inliner with the inflatable unit can simply be formed by stacking another sheet of the same size on top of the stack, followed by sealing all layers together. In this way, a liquid-stabilizing inliner is formed wherein the inflatable unit and the inliner share one and the same wall and are thus integrated. For the purpose of the invention, such inflatable unit will be termed an integrated inflatable unit.

In a liquid-stabilizing inliner with such integrated inflatable unit, the integrated inflatable unit has the same width as the inliner itself. This large width is advantageous when there is a large surface of the liquid that needs to be covered by the inflatable unit. This is for example the case when the liquid in the tank container reaches a height of less than 80% of the height of the tank container.

The integrated inflatable unit of such liquid-stabilizing inliner, however, cannot function as a handle because it is connected to the inliner along all its edges. Therefore, another inflatable unit that can fulfill such function is preferably connected to such inliner. Accordingly, in an embodiment, the integrated inflatable unit is present as an intermediate inflatable unit between the inliner and the inflatable unit with handle-functionality. Thus, a liquid-stabilizing inliner of the invention may comprise an intermediate inflatable unit that is present between the inliner and the inflatable unit, wherein

- the wall of the intermediate inflatable unit is formed by a part of the inliner wall and a sheet that is sealed along its edges to that part of the inliner wall, so that the intermediate inflatable unit and the inliner share part of their walls; and
- the inflatable unit is present on top of the intermediate inflatable unit.

In such liquid-stabilizing inliner, parts of the inliner, the intermediate inflatable unit and the inflatable unit are typically connected in one sealing. This means that at each end of the liquid-stabilizing inliner, a short edge of the inliner, a short edge of the intermediate inflatable unit and a short edge of the inflatable unit are combined in one sealing.

The inflatable unit may comprise one single compartment, but it is also possible that a plurality of compartments is present. These may be separately inflatable, but they may also be interconnected by air channels. When a valve is present for inflation, interconnected compartments may be inflated from a single valve. When the compartments are not connected, then a plurality of valves would be required.

FIG. 1 displays a liquid-stabilizing inliner according to the invention wherein the inflatable unit comprises a single compartment.

FIG. 2 displays the situation wherein the inflatable unit comprises a plurality of compartments. The different compartments are connected via air channels, so that they can be inflated by one single inlet of gas.

FIG. 3 displays a top-view of a flat-lying liquid-stabilizing inliner of the invention wherein the inflatable unit comprises a plurality of compartments.

An advantage of a plurality of inflated compartments is that the inflatable unit in its totality can be made more rigid and so achieves a better damping of the waves of the liquid that is present in the inliner. By making the air channels that connect the compartments small enough, distribution of the gas over the different compartments is slow as compared to the movement of the liquid (speed of propagation of a wave of the liquid). In this way, a plurality of compartments (as e.g. shown in FIG. 2) can be more effective in damping the waves.

The invention further relates to a method for preparing a liquid-stabilizing inliner as described hereinabove, comprising

- providing an inliner having an inliner wall made of a film material, wherein the inliner wall
  - is configured as a bag to define an interior space for storing a liquid;
  - has an opening for the entrance of the liquid into the interior space and the discharge of the liquid from the interior space;
  - has an inner surface facing the interior space and an outer surface facing an exterior environment;
- providing an inflatable unit, wherein the inflatable unit
  - is of an elongated shape having a first end and a second end; and
  - is present in the interior space or in the exterior environment;
- connecting the inflatable unit to the inliner, in particular connecting the first end to one part of the inliner and connecting the second end to another part of the inliner.

The inliner as well as the inflatable unit are preferably made of a sealable plastic, so that the connecting step in the method may be performed by sealing the inflatable unit to the inliner.

In a preferred embodiment, the method comprises

- providing a stack of sheets of a sealable material, wherein the stack comprises
  - at least two, preferably four, sheets that lie on top of each other, the sheets being of a rectangular shape and having two short edges and two long edges;
  - a tubular film being of a rectangular shape and having two short edges and two long edges, wherein the long edges have the same length as the long edges of the at least two sheets and wherein the short edges are of the same length as or shorter than the short edges of the at least two sheets, the tubular film lying on top of the at least two sheets so that its short edges coincide with the short edges of the at least two sheets;
- sealing the long edges of the at least two sheets;
- sealing the short edges of the at least two sheets together with the short edges of the tubular film.

In this method, the at least two sheets may also be two tubular films. This effectively forms a stack of four sheets, wherein the bottom two sheets are connected at their long edges (because they are part of one tubular film) and the top two sheets are also connected at their long edges form (because they are part of the other tubular film).

The invention further relates to an assembly comprising a liquid-stabilizing inliner as described hereinabove and a tank container for the transport and/or storage of a liquid, wherein

- the tank container
  - is of a cylindrical-like shape and comprises a first end, a second end, and a longitudinal dimension that is present between the first end and the second end;
  - comprises a circumferential wall that is present between a wall at the first end and a wall at the second end;
  - comprises a drain hole in one of the walls;
  - comprises a manhole in one of the walls for inserting and removing the liquid-stabilizing inliner;
- the liquid-stabilizing inliner is present inside the tank container in a manner wherein
  - the opening in the inliner wall is aligned with the drain hole of the tank container;
  - the liquid-stabilizing inliner is oriented in such way that the inflatable unit is aligned with the longitudinal dimension of the tank container.

The opening in the inliner wall preferably comprises a spout. The alignment of the opening in the inliner wall with the drain hole of the tank container is usually achieved by placing the spout of the inliner wall into the drain hole of the tank container, so that a fluid connection is realized between the interior space of the inliner and the exterior environment.

In an assembly of the invention, the inliner is present inside the tank container. It has to be brought into the tank container via an opening different from the drain hole. Therefore, the tank container comprises a hole that is large enough for the (folded) inliner to pass through. Usually, such hole is a manhole, e.g. a hole that is large enough for one person to pass through, e.g. a hole with a diameter in the range of 25-50 cm (for placement of the liquid-stabilizing inliner of the invention into the tank container it is in principle not necessary for a person to go into the tank container). The hole is usually equipped with a door to close-off the hole. Preferably, the manhole is located close to the drain hole, so that the positioning of the inliner in the tank container is easy to carry out, in particular the placement of the spout of the inliner into the drain hole. Usually, the tank container also comprises a venting hole for the release of air during the filling of the container.

When the assembly is in use for the storage and/or transport of a liquid, the tank container (and thus in the inliner) may be partly filled with a liquid and the inflatable unit at least partly inflated so that the inflatable unit is squeezed between the inliner and the circumferential wall of the tank container.

The invention further relates to a method for preparing the assembly, the method comprising providing a tank container that is of a cylindrical-like shape and comprises a first end, a second end, and a longitudinal dimension that is present between the first end and the second end;

comprises a circumferential wall that is present between a wall at the first end and a wall at the second end;

comprises a drain hole in one of the walls;

comprises a manhole in one of the walls for inserting and removing the liquid-stabilizing inliner;

providing a liquid-stabilizing inliner;

bringing the liquid-stabilizing inliner into the inside of the tank container by passing it through the manhole;

aligning the opening in the inliner wall with the drain hole of the tank container;

orienting the liquid-stabilizing inliner in such way that the inflatable unit is aligned with the longitudinal dimension of the tank container.

In a particular embodiment, the method is followed by partly filling the inliner with a liquid; then at least partly inflating the inflatable item.

The invention claimed is:

1. A liquid-stabilizing inliner for use in a tank container, comprising:

an inliner having an inliner wall made of a film material, and an inflatable unit connected to the inliner, wherein the inliner wall:

(i) is configured as a bag to define an interior space for storing a liquid;

(ii) has an opening for the entrance of the liquid into the interior space; and (iii) has an inner surface facing the interior space and an outer surface facing an exterior environment; and wherein the inflatable unit comprises a film material that is configured as a bag to define an interior space for containing a gas.

2. The liquid-stabilizing inliner according to claim 1, wherein the inliner wall comprises at least two sheets of a rectangular shape lying on top of each other and being sealed together at respective edges so as to form the bag that defines the interior space for storing a liquid, wherein the inliner comprises two long edges and two short edges;

a longitudinal dimension is present between the two short edges of the inliner; and the opening merges into a spout and is positioned on or adjacent to a central line extending along the longitudinal dimension of the inliner.

3. The liquid-stabilizing inliner according to claim 1, wherein the inliner wall comprises a piece of tubular film of a rectangular shape having two ends, each of which is closed by means of a sealing line that connects at each end opposing portions of the tubular film, to thereby form the bag that defines the interior space for storing a liquid, wherein the inliner comprises two long edges and two short edges;

a longitudinal dimension is present between the two short edges of the inliner; and the opening merges into a spout and is positioned on or adjacent to a central line extending along the longitudinal dimension of the inliner.

4. The liquid-stabilizing inliner according to claim 1, wherein each of the inflatable unit and the inliner is an elongated shape having a first end and a second end, a longitudinal dimension between both ends, and a length that is defined as a distance between the first end and a second end, measured over a surface of the inflatable unit or the inliner, respectively;

the inliner and the inflatable unit have a relative orientation such that longitudinal dimensions of each of the inliner and the inflatable unit are aligned;

the inflatable unit is present in an exterior environment; and the inflatable unit is connected to the inliner by means of at least first and second connections, wherein the first connection is located at the first end of the inliner and/or at distance therefrom of not more than 25% of the length of the inliner, measured over the surface of the inliner; and the second connection, which is independent of the first connection, is located at the second end of the inliner and/or at distance therefrom of not more than 25% of the length of the inliner, measured over the surface of the inliner.

5. The liquid-stabilizing inliner according to claim 4, wherein there is no connection between the inliner and the inflatable unit over a distance in the longitudinal dimension of at least 50% of the length of the inliner, measured over the surface of the inliner.

6. The liquid-stabilizing inliner according to claim 4, wherein the first end of the inliner is connected to the first end of the inflatable unit and the second end of the inliner is connected to the second end of the inflatable unit.

7. The liquid-stabilizing inliner according to claim 4, wherein the at least first and second connections of the inflatable unit with the inliner comprise a sealing line with a width in a range of 2-20 cm.

8. The liquid-stabilizing inliner according to claim 2, wherein the inflatable unit is of a rectangular shape having two long edges and two short edges; and one short edge of the inflatable unit is connected to one short edge of the inliner and the other short edge of the inflatable unit is connected to the other short edge of the inliner.

9. The liquid-stabilizing inliner according to claim 8, further comprising an intermediate inflatable unit which is present between the inliner and the inflatable unit, wherein the wall of the intermediate inflatable unit is formed by a part of the inliner wall and a sheet that is sealed along edges thereof to that part of the inliner wall, so that respective parts of the walls of the intermediate inflatable unit and the inliner are shared; and the inflatable unit is present on top of the intermediate inflatable unit.

10. A method for preparing the liquid-stabilizing inliner according to claim 1, the method comprising:

(a) providing the inliner having the inliner wall made of a film material;

(b) providing the inflatable unit, wherein the inflatable unit:

is of an elongated shape having a first end and a second end; and is present in the interior space or in an exterior environment; and (c) connecting the inflatable unit to the inliner by connecting the first end of the inflatable unit to one part of the inliner and connecting the second end of the inflatable unit to another part of the inliner.

11. A method for preparing the liquid-stabilizing inliner according to claim 1, the method comprising:

(a) providing a stack of sheets of a sealable material, wherein the stack comprises:

at least two sheets that lie on top of each other, the sheets being of a rectangular shape and having two short edges and two long edges; and a piece of tubular film being of a rectangular shape and having two short edges and two long edges, wherein the long edges of the tubular film and the long edges of the at least two sheets have the same length, and wherein the short edges of the tubular film are of the same length as or shorter than the short edges of the at least two sheets, the tubular film lying on top of the at least two sheets so that the short edges of the tubular film coincide with the short edges of the at least two sheets; and then (b) sealing the long edges of the at least two sheets; and (c) sealing the short edges of the at least two sheets together with the short edges of the tubular film.

12. An assembly comprising the liquid-stabilizing inliner according to claim 1 and a tank container for the transport and/or storage of a liquid, wherein the tank container is of a cylindrical-like shape and comprises:

a first end, a second end, a longitudinal dimension that is present between the first end and the second end;

a circumferential wall that is present between a wall at the first end and a wall at the second end;

a drain hole in one of the walls; and a manhole in one of the walls for inserting and removing the liquid-stabilizing inliner; and wherein the liquid-stabilizing inliner is present inside the tank container in a manner wherein the opening in the inliner wall is aligned with the drain hole of the tank container; and the liquid-stabilizing inliner is oriented in such way that the inflatable unit is aligned with the longitudinal dimension of the tank container.

13. The assembly according to claim 12, wherein the tank container is partly filled with a liquid and the inflatable unit is at least partly inflated so that the inflatable unit is squeezed between the inliner and the circumferential wall of the tank container.

14. A method for preparing an assembly according to claim 12, the method comprising:

(a) providing the tank container;

(b) providing the liquid-stabilizing inliner;

(c) bringing the liquid-stabilizing inliner into an inside of the tank container by passing the liquid-stabilizing inliner through the manhole;

(d) aligning the opening in the inliner wall with the drain hole of the tank container; and (e) orienting the liquid-stabilizing inliner in such way that the inflatable unit is aligned with the longitudinal dimension of the tank container.

15. The method according to claim 14, which further comprises:

(f) partly filling the inliner with a liquid; and then (g) at least partly inflating the inflatable item.

* * * * *